United States Patent [19]

Danner

[11] Patent Number: 4,572,721

[45] Date of Patent: Feb. 25, 1986

[54] METHOD FOR DEGREASING NATURAL SKINS, HIDES AND PELTS

[75] Inventor: Bernard Danner, Riedisheim, France

[73] Assignee: Sandoz Ltd., Basel, Switzerland

[21] Appl. No.: 618,463

[22] Filed: Jun. 8, 1984

[30] Foreign Application Priority Data

Jun. 9, 1983 [DE] Fed. Rep. of Germany ..... 3320748

[51] Int. Cl.[4] ..... C14C 1/00

[52] U.S. Cl. ..... 8/94.1 R; 8/94.18; 8/139; 252/8.57

[58] Field of Search ..... 8/94.1 R, 94.18, 139; 252/8.57

[56] References Cited

U.S. PATENT DOCUMENTS 2,283,421 5/1942 Castendyk ..... 8/139
3,630,661 12/1971 Ramier et al. ..... 8/139
4,270,912 6/1981 Prentiss ..... 252/8.57
4,285,689 8/1981 Siegler ..... 252/8.57

FOREIGN PATENT DOCUMENTS 620783 3/1949 United Kingdom .

OTHER PUBLICATIONS

Chemical Abstracts, 94 (1981) 85689v.
Leather and Shoes, Jan. 30, 1960, pp. 18–20.

*Primary Examiner*—Paul Lieberman
*Assistant Examiner*—Willie J. Thompson
*Attorney, Agent, or Firm*—Gerald D. Sharkin; Richard E. Vila; Thomas C. Doyle

[57] ABSTRACT

Skins, hides and pelts are effectively degreased under mild conditions prior to tanning, in the presence of an organic primary, secondary or tertiary amine having surface-active properties and containing at least one lipophilic residue and at least one ethylene oxide unit, optionally in admixture with a non-ionic emulsifier.

26 Claims, No Drawings

METHOD FOR DEGREASING NATURAL SKINS, HIDES AND PELTS

This invention relates to a process for degreasing skins, hides and pelts in an aqueous medium prior to tanning.

The removal of natural hide grease prior to tanning still leaves much to be desired, particularly in the case of greasy skins. Frequently the skins cannot be completely freed from grease or the grease cannot be thoroughly extracted without damaging the skins, or the extracted grease is redeposited on the hides and the equipment thus causing smearing of the skins.

It has now been found that natural skins, pelts or hides can be thoroughly degreased under mild conditions without damaging the skins by using as degreasing agent an organic amine having surface-active properties and containing at least one ethylene oxide (EO) unit per molecule, in an aqueous medium.

Accordingly, the present invention provides a process for degreasing natural skins, pelts and hides in an aqueous medium prior to tanning, which process comprises the step of treating the skins, pelts and hides with an aqueous solution or dispersion of an organic primary, secondary or tertiary amine having surface-active properties and containing, per molecule, at least one lipophilic residue and at least one ethylene oxide unit.

The amines used in the process of the invention have hydrophilic properties to the extent that they are either water-soluble or at least self-dispersible in water. By "water-soluble" is meant that the amine is soluble in water at 20° C. and pH$\leqq$7 at an amount which is effective for degreasing the skins, the resulting aqueous solution being a true or colloidal solution. By "self-dispersible" is to be understood that the amine can be dispersed in water at 20° C. and pH$\leqq$7 when used at an amount which is effective for degreasing the skins, thus giving a stable dispersion or a dispersion which can readily be re-dispersed by simple stirring after phase separation on storage.

Each lipophilic residue present in the amine advantageously contains from 9 to 50 carbon atoms and may be monovalent or divalent. When the lipophilic residue is monovalent, it is preferably an aliphatic or araliphatic radical containing from 9 to 24, more preferably from 9 to 22 carbon atoms and may be in form of an alkyl, alkenyl, alkaryl, alkenylaryl or acyl group. When divalent, the lipophilic residue preferably contains from 24 to 50, more preferably from 36 to 44 carbon atoms and may be a residue derived from a fatty diacid, particularly of a dimeric unsaturated fatty acid.

The amines useful for the process of the invention contain at least one nitrogen atom having basic properties, i.e. a nitrogen atom which can be protonated under mild acid conditions. As already mentioned the amine contains at least one EO unit per molecule, such unit being preferably fixed on the basic nitrogen atom. Preferably the amine contains at least one, preferably at least two EO units per lipophilic residue present in the molecule. When the amine molecule bears two or more EO units, up to 50 mole % of the EO units may be replaced by propylene oxide (PO) units. The length of the EO chain(s) or EO/PO chain(s) is selected to the extent that the oxyalkylated amine has substantial surface-active properties. Preferably the amine contains no PO units, only EO units, preferably from 2 to 40 EO units.

As already mentioned, the amines may be primary, secondary or tertiary. Preferably they are tertiary.

Suitable amines according to the invention include monoamines containing one or two lipophilic residues, mono- or poly-alkylene-polyamines containing one or two lipophilic residues, monoacylated N-($\beta$-aminoethyl)-N-($\beta$-hydroxyethyl)amines or di- or tetraamines which are obtainable from aminated dimeric unsaturated fatty acids.

In the mono- and poly-alkylene-polyamines each alkylene bridging group advantageously contains from 2 to 6 carbon atoms and may be non-cyclic or cyclic, e.g. two alkylene may form a cycle together with the two nitrogen atoms to which they are bound such as piperazine or N-($\beta$-aminoethyl)-piperazine. Preferred non-cyclic alkylene bridging groups are ethylene and 1,3-propylene. Suitable mono- and poly-alkylene-polyamines containing non-cyclic alkylene groups are for example those derived from monoethylenediamine, monopropylenediamine, diethylenetriamine, dipropylenetriamine, triethylenetetramine, tripropylenetetramine, tetraethylenepentamine, tetrapropylenepentamine or N-aminoethyl-propylene diamine.

When the amine contains a lipophilic acyl group adjacent to an amino group substituted by a $\beta$-aminoethyl group such may be converted into an imidazoline ring according to known methods.

Further suitable amines according to the invention are for example the amination products of an epichlorhydrin ether containing at least one lipophilic residue with ammonia, a mono- or poly-alkylene-polyamine such as defined above (comprising also cyclic alkylene bridging and imidazoline rings), an aliphatic monoamine or a cyclic amine containing optionally a further heteroatom, particularly oxygen, the resulting amination product containing at least one EO unit per molecule, preferably as indicated above.

Suitable epichlorohydrin ethers are mono- or polyepichlorhydrin ethers derived from fatty alcohols containing at least 9 carbon atoms, preferably from 9 to 22 carbon atoms, or from mono-, di- or tri-alkyl phenols containing at least at total of 12 carbon atoms, preferably from 14 to 24 carbon atoms. The fatty alcohols and alkyl phenols may optionally be ethoxylated or ethoxylated and propoxylated (in any sequence) to the extent as already indicated above for the amines. Preferred aliphatic monoamines used for the aminating reaction are $C_{2-4}$ alkanolamines, e.g. mono-alkanolamines such as ethanolamine, isopropanolamine or isobutanolamine, dialkanolamines such as diethanolamine, diisopropanolamine or diisobutanolamine, or N-$C_{1-4}$alkyl-N-$C_{2-4}$alkanolamines, e.g. N-methyl-N-ethanolamine. Cyclic amines suitable for the aminating reaction of epichlorhydrin ethers are for example piperidine and morpholine.

In particular the following types of amines are preferred as degreasing agents in the process of the invention:

(a) amines of formula I $$R_1—X \qquad \text{I}$$

in which $R_1$ is a linear aliphatic $C_{8-21}$ hydrocarbon residue and X is a radical selected among those of formula ($\alpha$), ($\beta$) and ($\gamma$)

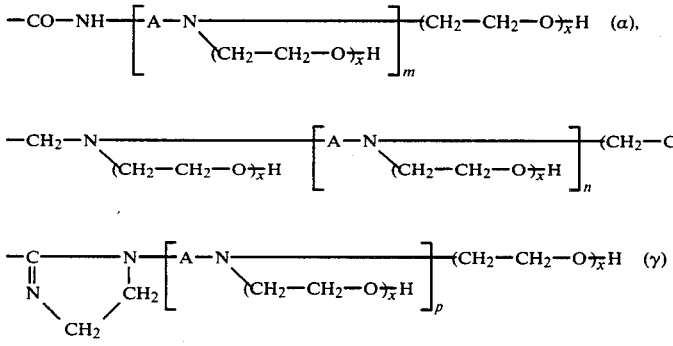

in which m is an integer from 1 to 4 n is 0, 1, 2 or 3 p is 0, 1, 2 or 3

A is ethylene or 1,3-propylene, and each x, independently, has the same or a different numerical value the total of ethylene oxide units in each formula (α) to (γ), independently, being from 3 to 30

(b) amines of formula II

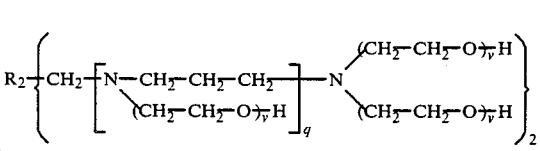

in which $R_2$ is a divalent $C_{36-42}$ aliphatic hydrocarbon residue q is 0 or 1 and each v, independently, has the same or a different numerical value the total of ethylene oxide units being from 15 to 40

(c) amination products from compounds of formula III

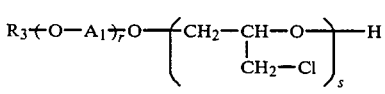

in which $R_3$ is $C_{9-22}$alkyl, $C_{9-22}$alkenyl, di-($C_{4-12}$alkyl)-phenyl or mono-($C_{8-18}$alkyl)-phenyl each $A_1$ independently is ethylene or 1,2-propylene r is a number from 0 to 40 s is a number from 1 to 5 with ammonia, a mono-$C_{2-4}$ alkanolamine, a di-$C_{2-4}$ alkanolamine or an amine of formula IV

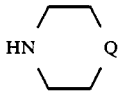

in which Q is —O—, —$CH_2$—, —NH— or

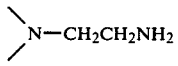

or of formula V

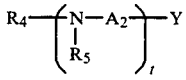

in which t is 0 or an integer from 1 to 5

Y is —$NR_6R_7$ or, when t>1 also —$NHCOR_8$ each $A_2$, independently, is ethylene or 1,3-propylene each $R_4$, $R_5$ and $R_6$, independently, is H or $C_{1-4}$alkyl $R_7$ is H, $C_{1-22}$alkyl or $C_{14-18}$alkenyl and $R_8$ is an aliphatic $C_{1-21}$ hydrocarbon residue at least one of $R_4$, $R_5$, $R_6$ and $R_7$ being hydrogen, and their ethoxylated derivatives, the molecule containing at least two ethylene oxide units per hydrocarbon residue containing 8 or more carbon atoms present in the molecule.

In the amines of formula I, $R_1$ is preferably an aliphatic hydrocarbon residue containing from 12 to 22, more preferably from 14 to 18 carbon atoms. Such residue may be saturated or unsaturated (if unsaturated, preferably monoethylenically unsaturated); it may be in form of an alkyl or alkenyl group, oleyl being particularly preferred as alkenyl. The total of ethylene oxide units in each formula (α) to (γ), independently, is preferably 5 to 20.

In the amines of formula II q is preferably 0. The total of ethylene oxide units is preferably from 10 to 25. $R_2$ is preferably a divalent residue derived from a dimeric unsaturated fatty acid, for example dimeric oleic acid.

In the epichlorohydrin ethers of formula III, $A_1$ is preferably ethylene. r is preferably a numeral from 0 to 12. s is preferably 1. When $R_3$ is alkyl or alkenyl, such may be linear or branched; preferably it is linear $C_{12-18}$alkyl or $C_{12-18}$alkenyl, for example lauryl, stearyl or oleyl. When $R_3$ is alkyl phenyl, the alkyl moiety may be linear or branched and preferably contains from 8 to 12 carbon atoms. Preferred alkyl phenyl groups are those in which the alkyl moiety is in ortho or para position for example p-isooctylphenol, p-nonylphenyl or p-dodecylphenyl. When $R_3$ is di-alkylphenyl, it is preferably dibutylphenyl.

In the compounds of formula V, t is preferably 0, 1 or 2. $R_4$, $R_5$, $R_6$ and $R_7$ are preferably all hydrogen. Y is preferably $—NR_6R_7$.

Preferably the amination products defined under (c) contain from 5 to 20 EO units per molecule.

Particularly preferred amines are those of formula I, especially those in which X is a radical of formula (β).

The amines useful as degreasing agents in the process of the invention are known compounds or compounds obtainable according to known methods. For example compounds of formula I can be obtained by acylation and ethoxylation of amines such as diethylenetriamine triethylenetetramine and β-(β'hydroxyethylamino)-ethanolamine. The amines may be used in form of mixtures, particularly technical mixtures, e.g. as obtained from technical starting mixtures.

The amines may be used in free base or protonated form. If in protonated form, which is preferred, they are preferably protonated by an inorganic acid, e.g. hydrochloric acid or sulphuric acid or by an organic acid such as a carboxylic acid having a low molecular weight, e.g. a mono- or dicarboxylic acid such as formic acid, acetic acid, phthalic acid, adipic acid or oxalic acid.

According to a preferred embodiment of the invention, the degreasing process is carried out in an aqueous medium containing, in addition to the amine, a non-ionic emulsifier. Suitable non-ionic emulsifiers are such as are conventionally used for example for the preparation of water-in-oil emulsions as well as oil-in-water emulsions, particularly such having an HLB value (Hydrophile/lipophile balance value) of at least 4. Preferably the non-ionic emulsifier has an HLB value of from 4 to 20, more preferably from 5 to 15, especially from 5 to 12.

Non-ionic emulsifiers suitable for the use with the amines according to the invention are compounds having at least one lipophilic hydrocarbon residue of at least 9, preferably 9–24 carbon atoms and at least one non-ionic hydrophilic residue, which is preferably a mono- or polyethylene glycol group, optionally containing propylene glycol units, or the residue of a polyol e.g. glycerol, mannitol, pentaerythritol and sorbitol. Other suitable types include hydrophobic Pluronics and Tetronics in which the part of the molecule having a high propylene oxide content can be regarded as the lipophilic residue.

Specific types of non-ionic emulsifiers include:

Partial fatty acid esters of polyols.

Products obtainable by addition of ethylene oxide and optionally propylene oxide (preferably EO alone) to aliphatic alcohols, alkyl phenols, fatty acids, fatty acid alkanol amides and partial fatty acid esters of polyols.

Preferred partial fatty acid esters of polyols are tris-, di- or, particularly, monoesters of aliphatic polyols containing at least 3 hydroxy groups, more particularly of glycerol, mannitol, pentaerythritol or sorbitol.

Preferred non-ionic emulsifiers are partial fatty acid esters of polyols and products obtainable by addition of ethylene oxide to saturated or unsaturated, linear or branched aliphatic alcohols, alkylphenols and aliphatic fatty acids.

Fatty acid residues may be saturated or unsaturated (if unsaturated, preferably monoethylenically unsaturated) and are preferably acyl groups having 9–24, preferably 12–20, carbon atoms, particularly residues of lauric, myristic, stearic and oleic acids. If an alkyl or alkenyl group is the sole lipophilic group, it has preferably 9–24, more preferably 9–18, carbon atoms and may be straight chain or branched. In alkyl-aryl groups, the alkyl group preferably has 4–12 carbon atoms and may also be straight or branched.

The length of the lipophilic residue and the number of EO units may be selected in order to obtain a non-ionic emulsifier or a mixture of non-ionic emulsifiers having an HLB value as indicated above. The HLB values of non-ionic emulsifiers may be calculated by use of standard formula.

The preferred number of ethylene oxide units in addition products of EO to aliphatic alcohols or alkyl phenols is from 2 to 30 and in addition products to fatty acids the number of EO units is preferably from 3 to 30. These numbers are average values and need not be integral.

Particularly preferred emulsifiers are those of formula VI and VII $$R_9—O—CH_2—CH_2)_gOH \quad (VI)$$

$$(R_{10}CO)_hX \quad (VII)$$

in which $R_9$ is $C_{9-24}$alkyl, $C_{9-24}$alkenyl or a group of formula (ε),

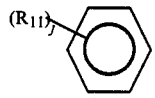

(ε)

in which each $R_{11}$, independently, is $C_{4-12}$alkyl and j is 1 or 2 g is a number from 2 to 30 h is 1 or 2

$R_{10}CO$— is the acyl residue of a $C_{12-20}$alkylcarboxylic acid and

X is a monovalent or divalent residue of sorbitol, glycerol or pentaerythritol or, when h=1, a group of formula (VIII)

$$—O—CH_2CH_2—O)_kH \quad (VIII)$$

in which k is a number from 3 to 30.

In compounds of formula VI g is preferably 3–30, more preferably 3–15.

In compounds of formula VII h is preferably 1.

The weight ratio of the amine to the non-ionic emulsifier may vary, depending on the properties of each. In general good results are obtained when the weight ratio is from 95:5 to 40:60, preferably from 85:15 to 50:50.

As will be appreciated, preliminary testing may be necessary to arrive at the optimum non-ionic emulsifier which may be used in admixture with the chosen amine. Such preliminary testing when necessary is however, well within the skill of the man in the art.

The amine may be added, optionally in admixture with the non-ionic emulsifier, to the treatment bath in form of a concentrated aqueous preparation (solution or dispersion). Preferred concentrated aqueous preparations are those containing from 20 to 80%, more preferably from 30 to 70% by weight of active substance (amine+non-ionic emulsifier when present).

The amine alone or in admixture with the non-ionic emulsifier is stable to electrolytes and may be employed at any pH-value which is normally used in the treatment steps prior to tanning, e.g. at a highly alkaline pH-value such as ≧11 as is usual for liming or at a very acidic pH-value as used for pickling. The amine is preferably used at a pH≦7.5, more preferably at a pH between 4 and 7.5.

The amount of amine to be employed in the process of the invention may vary within a large range depending on the nature of the substrate, e.g. pigskins and sheepskins have a higher fat content than calf- or goatskins, the step at which the degreasing is performed, e.g. after liming, particularly after the fermentative bate, or the desired effect, e.g. whether it is desired to obtain a full or partial degreasing effect. In general good results are obtained when the amine or the mixture amine+-non-ionic emulsifier is used in an amount of from 0.2 to 10% preferably 0.4 to 6% by weight (calculated as dry substance) based on the shaved weight of the substrate (skins, pelts and hides). When the substrate has a low fat content or when it is desired to obtain a partial degreasing effect, it is advantageous to use the compounds in an amount of from 0.2 to 2% by weight; more particularly in the case of a substrate to be degreased having a low fat content, it is preferred to employ from 0.4 to 1.6% by weight of amine or amine+emulsifier.

The process of the invention is preferably effected using one or more amines in admixture with one or more non-ionic emulsifiers.

The degreasing treatment of the invention may be carried out at any stage before tanning e.g. during soaking, liming, deliming, fermentative bating, pickling or before neutralisation. It is advantageously carried out in the beamhouse, particularly after liming, preferably before, during or after fermentative bating. When the fermentatively bated skins are pickled before tanning, it is preferred to degrease them during or after pickling. According to a preferred embodiment of the invention, the degreasing of the skins is effected after an intermediary rinsing step following the fermentative bate, during the pickling, the amine optionally together with the non-ionic emulsifier being added to the pickling solution, or after pickling, e.g. in the case of non-degreased pickled sheepskins.

The degreasing process of the invention, is preferably performed at a low liquor to goods ratio. More particularly the substrate is drummed with the aqueous bath in a first step at a ratio of from 8 to 80, preferably 10 to 20% by weight based on the shaved weight of the substrate, the treatment bath being then diluted in a second step to a ratio of from 30 to 500%, preferably from 50 to 300% by weight based on the shaved weight.

The amines may be used in the free base or in an at least partially protonated form. When they are used in an acidic bath containing an amount of acid sufficient for partial protonating of the amines, e.g. in deliming or pickling, they are advantageously added in the base form to the treatment bath.

The process of the invention enables the skins to be degreased under mild conditions, thus leading to a more uniform subsequent tanning and dyeing operation.

The following Examples, in which all parts and percentages are by weight, illustrate the invention. The temperatures are in degrees Centigrade. The fat content of the skins are based on the dry weight of the skins.

PRODUCT A

1 Mole stearic acid is condensed at 150° with 1 mole diethylenetriamine. After elimination of 1 mole water 0.5% sodium hydroxide based on the weight of the condensation product is added to the mixture which is then reacted at 120°-140° with 15 moles ethylene oxide. The resulting product contains, as main component, the following compound of formula (IX)

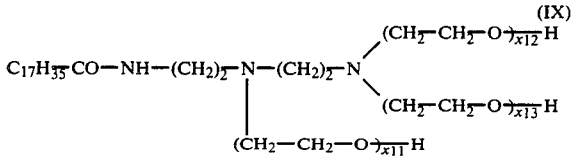

(IX)

$$x_{11} + x_{12} + x_{13} = 15$$

PRODUCT B

By following the procedure used for product A but replacing the stearic acid by oleic acid, there is obtained a product containing, as main component, a compound of formula X:

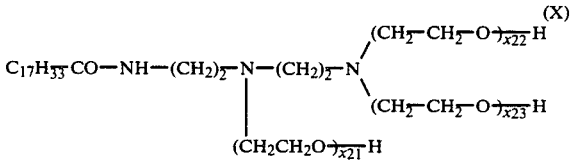

(X)

$$x_{21} + x_{22} + x_{23} = 15$$

PRODUCT C

10 Moles ethylene oxide are reacted at 150° in the presence of 0.5% sodium hydroxide (based on the weight of the amine) with 1 mole of an amine of formula (XI)

$$H_2N—R_{12}—NH_2 \quad (XI)$$

in which $R_{12}$ is a divalent saturated hydrocarbon residue having a MW of 590.

PRODUCT D

10 Moles ethylene oxide are reacted at 90°-110° in the presence of 0.1% sodium ethanolate with 1 mole of a technical mixture of amines of formula XII $$R_{13}—NH_2 \quad (XII)$$

in which $R_{13}$ is a mixture of alkyl and alkenyl of the following composition:

3% $C_{12}H_{25}$—Lauryl
3% $C_{14}H_{29}$—Myristyl
6% $C_{16}H_{33}$—Palmityl
4% $C_{16}H_{31}$—Hypogeyl
9% $C_{18}H_{37}$—Stearyl
75% $C_{18}H_{35}$—Oleyl.

PRODUCT E

1 Mole of a technical mixture of amines of formula XII is reacted first with 2 moles ethylene oxide in the presence of boron-trifluoride-etherate, and then with 8 moles ethylene oxide in the presence of sodium hydroxide at 100°-110° C.

PRODUCT F

15 Moles ethylene oxide are reacted at 90°-140° without catalysator with 1 mole of a technical amine of formula XIII $R_{14}$—NH—$CH_2)_3NH_2$ (XIII)

in which $R_{14}$ is a mixture of alkyl and alkenyl having the following composition:
0.1% $C_{12}H_{25}$—Lauryl
0.9% $C_{14}H_{29}$—Myristyl
28.0% $C_{16}H_{33}$—Palmityl
28.0% $C_{18}H_{37}$—Stearyl
43.0% $C_{18}H_{35}$—Oleyl.

PRODUCT G

1 Mole oleic acid is condensed at 165° with 1 mole N-(2-hydroxyethyl)-ethylenediamine. After elimination of 1.3 moles water, 0.5% sodium hydroxide (based on the weight of the condensation product) are added to the mixture which is then reacted at 120°-150° with 10 moles ethylene oxide. The resulting product contains, as main component, a compound of formula XIV

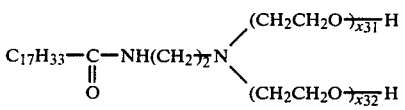

(XIV)

$x_{31} + x_{32} = 11$

PRODUCT H

2 Moles lauryl alcohol are reacted at 60°-70° with 2 moles epichlorhydrin in the presence of 1% tin tetrachloride (based on the weight of the lauryl alcohol). 1 Mole monoethanolamine are first reacted at room temperature (approx. 20°) with the resulting ether and then 2 moles of sodium hydroxide are reacted at 60°-70° in the form of a 30% aqueous solution. There is obtained the following product of formula XV $(C_{12}H_{25}$—O—$CH_2$—CHOH—$CH_2)_2N$—CH-$_2$—$CH_2$—OH (XV)

After drying, the product is freed from sodium chloride by filtration and then reacted at 160° with 10 moles ethylene oxide in the presence of 0.5% sodium hydroxide (based on the weight of the compound of formula XV).

PRODUCT J

70 Parts of product D are mixed with 30 parts of the addition product of 2 moles ethylene oxide to 1 mole lauryl alcohol.

PRODUCT K

70 Parts of product D are mixed with 30 parts of the addition product of 3 moles ethylene oxide to 1 mole p-nonylphenol.

PRODUCT L

70 Parts of product G are mixed with 30 parts of the addition product of 6 moles ethylene oxide to 1 mole p-nonylphenol.

PRODUCT M

28 Parts of product E are mixed with 12 parts of the addition product of 3 moles ethylene oxide to 1 mole lauryl alcohol (catalysed by sodium hydroxide), 10 parts of a 26% aqueous NaCl solution and 50 parts water.

EXAMPLE 1

Non neutralized, fleshed pickled sheepskins having a fat content of about 40% are treated as follows (the percentages are based on the pickled weight):

1. Degreasing

| Addition | Treatment duration |
|---|---|
| 10% water (25°)<br>3% product J, K or L or<br>6% product M | 30 minutes |
| 10% NaCl | 10 minutes |
| 50% water (25°) | 30 minutes |

2. Neutralisation

| Addition | Treatment duration |
|---|---|
| 0.5% sodium carbonate | 30 minutes |
| 0.5% sodium carbonate | 30 minutes |
| 0.5% sodium carbonate | 30 minutes |

The pH of the treatment bath is ca. 5.5-5.8. The extracted fat is finely dispersed in the treatment bath in form of a stable dispersion. 200% Water at 30° are then added to the treatment bath without altering deleteriously the fat dispersion. After discharging of the treatment bath, the skins are rinsed 3 times with 200% water at 35°.

3. Chrome-tanning

The resulting degreased neutralised skins are subsequently chrome-tanned as follows:

| Addition | Treatment duration |
|---|---|
| 50% water<br>5% NaCl | 10 minutes |
| 1% formic acid 85% | 30 minutes |
| 8% chromium sulphate with 26% $Cr_2O_3$ content and alkalinized to 33% | 16 hours |

and then dried.

The fat content of the resulting leather is then assessed on a sample according to known methods, e.g. by methylene chloride extraction. Depending on the sample, the degreasing product used and the skin parts, the degreased leather has a fat content reduced to 5-10%.

EXAMPLE 2

Non neutralised, fleshed pickled sheepskins having a fat content of about 40% are first neutralised as follows (the % are based on the pickled weight):

| Addition | Treatment duration |
|---|---|
| 10% NaCl | 5 minutes |
| 50% water | 30 minutes |
| 0.5% sodium bicarbonate | 30 minutes |
| 0.5% sodium bicarbonate | 30 minutes |
| 0.5% sodium bicarbonate | 30 minutes |

The treatment bath has a pH value of ca. 5.8-6.2. After discharging of the neutralisation bath, the skins are degreased as follows:

| Addition | Treatment duration |
|---|---|
| 10% water at 35°<br>3% product J, K or L or<br>6% product M | 30 minutes |
| 200% water at 35° | 30 minutes |

The grease extracted from the skins is finely dispersed in the treatment bath in form of a stable dispersion. After discharging of the treatment bath, the skins are rinsed 3 times successively with 200% water at 35° for 30 minutes.

After chrome-tanning as disclosed in Example 1 and drying the fat content of the resulting leather is assessed. Depending on the product used and the skins, the fat content has been lowered to 4–12%.

EXAMPLE 3

Pickled sheepskins having a dry weight of 300–350 g, a pickled weight of 600–700 g and a fat content of ca. 30% are neutralised as disclosed in Example 2 and then degreased as follows (the % are based on the pickled weight):

| Addition | Treatment duration |
|---|---|
| 10% water at 35° | 30 minutes |
| 3% of a product A to H | 30 minutes |
| 200% water at 35° | 30 minutes. |

The treatment bath has a grease content of 35–45 g/l which corresponds to a degreasing of 60–80% of the skins.

EXAMPLE 4

Soaked, salted cattle skins are limed as follows (the % are based on the salted weight):

| Addition | Treatment durration |
|---|---|
| 200.0% water at 20°<br>3.5% lime<br>2.5% sodium sulfide 60%<br>0.5% product M | 15–17 minutes |

After discharging of the bath, the skins are washed with 200% water at 20° for 15 minutes and the washing bath is discharged. Compared with skins limed in the absence of product M the resulting skins have an improved cleaner aspect, the natural hide grease being better distributed.

EXAMPLE 5

After bating and deliming, cattle skins are treated as follows (the % are based on the skin weight):

| Addition | Treatment time |
|---|---|
| 0.5% product M | 10–15 minutes |
| 200.0% water at 35° | 10–15 minutes |

The treatment bath is then discharged. The resulting skins are clean, substantially freed from scut and scurf.

What is claimed is:

1. A process for degreasing a substrate selected from the group consisting of natural skins, pelts and hides, which comprises treating the substrate, prior to tanning, with an aqueous medium having dissolved or dispersed therein a degreasing-effective amount of a primary, secondary or tertiary amine or mixture thereof, said amine having surface-active properties, containing, per molecule, at least one lipophilic residue and at least one ethylene oxide unit and being in free base or at least partially protonated form.

2. A process according to claim 1 in which the aqueous medium further contains a non-ionic emulsifier having an HLB value of from 4 to 20.

3. A process according to claim 1 wherein the amine bears at least two units selected from ethylene oxide and propylene oxide, provided that at least 50 mole percent of said units are ethylene oxide.

4. A process according to claim 3 wherein the amine is a tertiary amine in which each liphophilic residue is a monovalent aliphatic or araliphatic radical containing from 9 to 24 carbon atoms or a divalent residue containing from 24 to 50 carbon atoms and derived from a fatty diacid.

5. A process according to claim 1, in which each lipophilic residue present in the amine is a monovalent aliphatic or araliphatic radical containing from 9 to 24 carbon atoms or a divalent residue containing from 24 to 50 carbon atoms and derived from a fatty diacid.

6. A process according to claim 1, in which the amine contains at least one ethylene oxide unit per lipophilic residue present in the molecule.

7. A process according to claim 1 in which the amine is a tertiary amine.

8. A process according to claim 4, in which the amine is a monoamine containing one or two lipophilic residues, a mono- or poly-alkylene-polyamine containing one or two lipophilic residues, a monoacylated N-(β-aminoethyl)-N-(β-hydroxyethyl)amine or a di- or tetramine containing a divalent lipophilic residue.

9. A process according to claim 4, in which the amine is an amination product of an epichlorhydrin ether containing at least one lipophilic residue with ammonia, a mono- or poly-alkylene-amine, an aliphatic monoamine or a cyclic amine containing optionally a further heteroatom.

10. A process according to claim 9 in which the amine is an amination product of a mono- or poly-epichlorhydrin ether derived from optionally ethoxylated fatty $C_{9-22}$ alcohols or $C_{14-24}$mono-, di- or tri-alkylphenols.

11. A process according to claim 1, in which the amine is selected from a compound of formula I $$R_1—X \qquad \text{I}$$

in which $R_1$ is a linear aliphatic $C_{8-21}$ hydrocarbon residue and

X is a radical selected among those of formula (α), (β) and (γ)

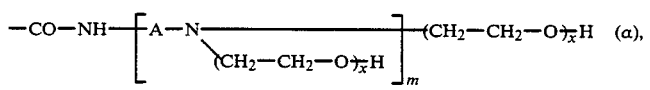

-continued

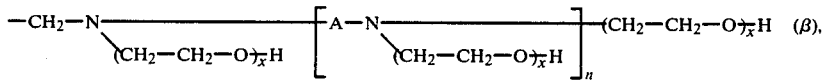

(β),

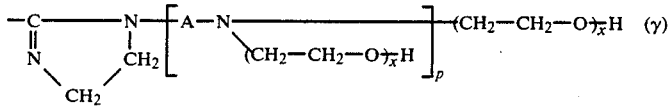

(γ)

in which m is an integer from 1 to 4 n is 0, 1, 2 or 3 p is 0, 1, 2 or 3

A is ethylene or 1,3-propylene, and each x, independently, has the same or a different numerical value the total of ethylene oxide units in each formula (α) to (γ), independently, being from 3 to 30, and a compound of formula II

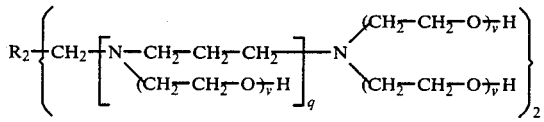

(II)

in which $R_2$ is a divalent $C_{36-42}$ aliphatic hydrocarbon residue q is 0 or 1 and each v, independently, has the same or a different numerical value the total of ethylene oxide units being from 15 to 40.

12. A process according to claim 1, in which the amine is an amination product of a compound of formula III

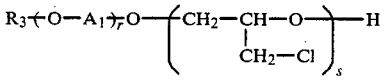

(III)

in which $R_3$ is $C_{9-22}$alkyl, $C_{9-22}$alkenyl, di-($C_{4-12}$alkyl)-phenyl or mono-($C_{8-18}$alkyl)-phenyl each $A_1$ independently is ethylene or 1,2-propylene r is a number from 0 to 40 s is a number from 1 to 5 with ammonia, a mono-$C_{2-4}$ alkanolamine, a di-$C_{2-4}$ alkanolamine or an amine of formula IV

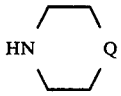

(IV)

in which Q is —O—, —$CH_2$—, —NH— or

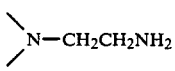

or of formula V

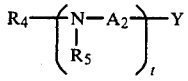

(V)

in which t is 0 or an integer from 1 to 5

Y is —$NR_6R_7$ or, when t>1 also —$NHCOR_8$ each $A_2$, independently, is ethylene or 1,3-propylene each $R_4$, $R_5$ and $R_6$, independently, is H or $C_{1-4}$alkyl $R_7$ is H, $C_{1-22}$alkyl or $C_{14-18}$alkenyl and $R_8$ is an aliphatic $C_{1-21}$ hydrocarbon residue at least one of $R_4$, $R_5$, $R_6$ and $R_7$ being hydrogen, or an ethoxylated derivative thereof, the molecule containing at least two ethylene oxide units per hydrocarbon residue containing 8 or more carbon atoms present in the molecule.

13. A process according to claim 2, in which the non-ionic emulsifier is a partial fatty acid ester of a polyol or an addition product of ethylene oxide and optionally propylene oxide to a compound selected from aliphatic alcohols, alkylphenols, fatty acids, fatty acid alkanolamines and partial fatty acid esters of polyols.

14. A process according to claim 2, in which the non-ionic emulsifier is selected from compounds of formulae VI and VII $$R_9—O—CH_2—CH_2)_gOH \quad (VI)$$

$$(R_{10}CO)_hX \quad (VII)$$

in which $R_9$ is $C_{9-24}$alkyl, $C_{9-24}$alkenyl or a group of formula (ε),

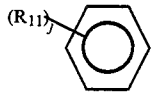

(ε)

in which each $R_{11}$, independently, is $C_{4-12}$alkyl and j is 1 or 2 g is a number from 2 to 30 h is 1 or 2

$R_{10}CO$— is the acyl residue of a $C_{12-20}$alkylcarboxylic acid and X is a monovalent or divalent residue of sorbitol, glycerol or pentaerythritol or, when h=1, a group of formula (VIII)

$$—O—CH_2CH_2—O)_kH \quad (VIII)$$

in which k is a number from 3 to 30.

15. A process according to claim 1, in which the amine is used in an amount from 0.2 to 10% (calculated as dry substance) based on the shaved weight of the substrate.

16. A process according to claim 1, in which the treatment is carried out before, during or after fermentative bating.

17. A process according to claim 1, in which the treatment is effected at a pH≦7.5.

18. A process according to claim 2 wherein the amount of amine plus non-ionic emulsifier is 0.2 to 10%, dry weight, based on the shaved weight of the substrate.

19. A process according to claim 4 wherein any monovalent lipophilic radical is alkyl, alkenyl, alkaryl, alkanoyl or alkenoyl and any divalent lipophilic radical is a residue of a dimeric unsaturated fatty acid.

20. A process according to claim 11 wherein, in formula I, $R_1$ is saturated or unsaturated and contains 12 to 22 carbon atoms and the total number of ethylene oxide units is 5 to 20 and, in formula II, q is 0, $R_2$ is a divalent residue of a dimeric unsaturated fatty acid and the total number of ethylene oxide units is 10 to 25.

21. A process according to claim 11 wherein the amine is of formula I in which X is a radical of formula ($\beta$).

22. A process according to claim 12 wherein, in formula III, $A_1$ is ethylene, r is 0 to 12, s is 1 and $R_3$ is $C_{12-18}$alkyl or alkenyl, phenyl monosubstituted by $C_{8-12}$alkyl, or dibutylphenyl; in formula V, t is 0, 1 or 2, Y is —$NR_6R_7$ and $R_4$, $R_5$, $R_6$ and $R_7$ are hydrogen; and the amination product contains 5 to 20 ethylene oxide units per molecule.

23. A process according to claim 11 wherein the amount of amine is 0.2 to 10%, dry weight, based on the shaved weight of the substrate.

24. A process according to claim 11 wherein the aqueous medium contains a non-ionic emulsifier in an amount such that the weight ratio of amine to non-ionic emulsifier is in the range 95:5 to 40:60.

25. A process according to claim 21 wherein the amount of amine is 0.2 to 10%, dry weight, based on the shaved weight of the substrate.

26. A process according to claim 21 wherein the amine is a mixture of compounds in which $R_1$ is lauryl, myristyl, palmityl, hypogeyl, stearyl and oleyl and, in formula ($\beta$), n is 0 and the total number of ethylene oxide units is 10.

* * * * *